US005131624A

United States Patent [19]

Kreuter et al.

[11] Patent Number: 5,131,624

[45] Date of Patent: Jul. 21, 1992

[54] ELECTROMAGNETICALLY OPERATING SETTING DEVICE

[75] Inventors: Peter Kreuter, Aachen; Martin Scheidt, Eschweiler, both of Fed. Rep. of Germany

[73] Assignee: FEV Motorentechnik GmbH & Co. KG, Aachen, Fed. Rep. of Germany

[21] Appl. No.: 542,951

[22] Filed: Jun. 25, 1990

[30] Foreign Application Priority Data

Jun. 27, 1989 [DE] Fed. Rep. of Germany ..... 3920976

[51] Int. Cl.[5] ..... F16K 31/06; F01L 9/04

[52] U.S. Cl. ..... 251/129.18; 251/129.1; 251/129.16; 123/90.11; 335/266

[58] Field of Search ..... 251/129.18, 129.16; 123/90.11; 335/266

[56] References Cited

U.S. PATENT DOCUMENTS 4,715,330 12/1987 Buchl ..... 251/129.18 X 4,777,915 10/1988 Bonvallet ..... 123/90.11

*Primary Examiner*—Arnold Rosenthal

*Attorney, Agent, or Firm*—Watson, Cole, Grindle & Watson

[57] ABSTRACT

With an electromagnetically operating setting device according to the principle of the spring-mass-oscillator, in particular to actuate control valves in displacement engines, the working stroke of the control element is varied by changing the position of the pole surface of a working magnet and the base of one or more springs of the spring system. To this end, a magnetic switching system serves to simultaneously change the distance of the pole surface and adapt the oscillation mid-point to the new position of the pole surface by changing the position of one or more spring bases. Furthermore, with this switching system the magnetic reluctances of one or both working magnets can also be changed.

17 Claims, 4 Drawing Sheets

ELECTROMAGNETICALLY OPERATING SETTING DEVICE

RELATED APPLICATIONS

This application relates to U.S. Ser. No. 07/542,931, filed Jun. 25, 1990, which corresponds to German application Serial No. P 39 20 931.8 and U.S. Ser. No. 07/542,949, filed Jun. 25, 1990, which corresponds to German application P 39 20 978.4, which are commonly owned with the present application and the specifications of which are herein incorporated by reference.

BACKGROUND OF THE INVENTION

1. Technical Field of the Invention

The present invention relates to an electromagnetically operating setting device for oscillatingly movable control elements on displacement engines, in particular for flat slide valves and lift valves, comprising a spring system and two electrically operating switching magnets, called working magnets in the following, by means of which an armature actuating the control element can be moved into two opposing switching positions, wherein the place of equilibrium position of the spring system lies between the two switching positions and the working stroke of the control element can be varied by changing the position of the pole surface of a working magnet and of the base of one or more springs of the spring system.

2. Discussion of the Related Art

In a setting device of the aforementioned kind, the control element of a displacement engine is held in the closed state by a compression spring. Another compression spring acts on the armature interacting with the control element so that the position of equilibrium of the spring system lies in the center or close to the center between the end positions of the movement of the armature. The end positions of the movement of the armature are at respective electrically actuated working magnets. To switch this device, one working magnet is excited and the other is switched off. Due to the force of the prestressed spring, the armature is accelerated upon release as far as the counteracting force of the other spring on its further path. Due to this friction, the armature cannot reach the opposing end position. The armature is attracted by the tractive force of the working magnet over the remaining distance.

In contrast to switching systems that attract the armature against the force of a spring over the entire stroke, with this system a significant reduction in the electric energy supplied and the size of the model is obtained. Owing to the small air gap to be bridged, the radial dimension of the winding window can be kept small. This is especially important with respect to the use of the setting device on displacement engines.

The working stroke of such a setting device is designed in such a manner that an opening has an adequate cross-section for the largest mass flow at the control element of a displacement engine and thus throttling is avoided.

With smaller mass flows, which occur when displacement engines, and especially internal combustion engines, are operating under partial load, operating the setting device at this maximum working stroke is inefficient since the electric energy to be supplied to change the position of the control element increases as a function of the stroke of the control element. Thus, a decreased stroke of the control element, in particular a decreased valve lift, is desired for energy reasons. Furthermore, a decrease in the cross-section of the opening results in an increase in the velocity of flow at the control element or at the control valve, a state that contributes to an improvement in the multi-phase fuel induction, especially in the air/fuel mixing in internal combustion engines.

Known systems to vary the working stroke of a setting device of the functional principle described above operate with switching or adjusting systems that are arranged outside the setting device or act together on several setting devices, as known, for example, from U.S. Pat. No. 4,777,915. A significant drawback of this design is a slow adjusting procedure which extends over several cycles of the internal combustion engine and renders digital control of the setting device difficult.

Accordingly, it is an object of the present invention to be able to fix in at least two different positions the working stroke of the setting device. This change-over is to take place in an internal combustion engine in a time span that is distinctly shorter than the time it takes for an internal combustion engine to go through one cycle.

Other objects and advantages are apparent from the specification and drawings which follow.

SUMMARY OF THE INVENTION

The foregoing and additional objects are obtained in a setting device of the aforementioned kind by means of a magnetic switching system to simultaneously change the distance of the pole surfaces and adapt the center point of oscillation to the new position of the pole surfaces by changing the position of one or more spring bases.

According to another embodiment of the invention, the magnetic reluctance of the magnetic circuit of one or both working magnets is changed when the working stroke of the setting device is changed, with the goal of keeping constant the time span between switching off the current of one working magnet and the start of the movement of the armature, which is referred to as the decay time in the following.

According to another embodiment of the invention, both the magnetic reluctance and the working magnet assigned to the open position and the spring base are adjusted by a common electromagnetic switching system in the one direction and by prestressed springs in the opposite direction.

The design of the switching system and the springs is chosen in accordance with other features of the invention in such a manner that after the electromagnetic switching system has been switched off, the adjustable components move automatically into one of the end positions, these end positions being either the position of the largest working stroke, or the position of the smallest working stroke of a valve of a displacement engine.

According to another embodiment of the invention, the control element can be actuated via a transfer element, in particular a rocker arm or finger follower.

To minimize the generation of noise and wear of the components of the electromagnetic switching system, according to another embodiment of the invention the movement of the switching system in the vicinity of one or both end positions is braked. Thus, kinetic energy can be withdrawn from the oscillatingly moved armature of the setting device in the vicinity of the end positions by compressing a compressible medium.

Furthermore, the electromagnetic switching system can contain a permanent magnet which ensures that the armature of the switching system will remain in the pulled-in position.

To compensate the for linear changes that take place when operating the setting device, according to another embodiment of the invention a hydraulic length compensating element can be used. According to the invention, this component can be mounted at different positions within the setting device, in particular in the armature or between the working magnet assigned to the closing position and the housing.

To reduce the cost of energy, in particular to hold the armature on the pole surfaces, according to another embodiment of the invention one or both working magnets can be equipped with a permanent magnet.

The design of the component affecting the magnetic reluctance is chosen in such a manner according to another embodiment of the invention that the component moved relative to the working magnet can be displaced to a limited degree against a prestress force and thus one can compensate for linear changes, or the adjustment during assembly is simplified. The prestress force is generated by deforming a flexible element.

In addition to the advantages already cited above, another advantage that can be achieved by the invention is that all of the components to be changed in their position when a working stroke of a setting device is adjusted can be mutually adjusted. The switching period that can be obtained is definitely less than the time that is available for one entire cycle of a displacement engine. Thus, it is possible to control the setting device digitally. In addition, the assignment of one switching system to each setting device permits the free positioning of setting devices in a multi-cylinder displacement engine. By adjusting different magnetic reluctances in the switching positions it is possible to operate the setting devices in the different switching positions with unmodified control signals.

The described attenuation of the movement, hydraulic length compensation and the use of permanent magnets lower the energy usages; attenuation and hydraulic length compensation also improve the drivability. The displaceable design of the component affecting the magnetic reluctance causes a decrease in the requirements concerning accuracy in production and adjustment.

BRIEF DESCRIPTION OF THE DRAWINGS

Embodiments of the invention are described with reference to the drawings as follows.

DETAILED DESCRIPTION OF THE PREFERRED EMBODIMENTS

Figure 1:
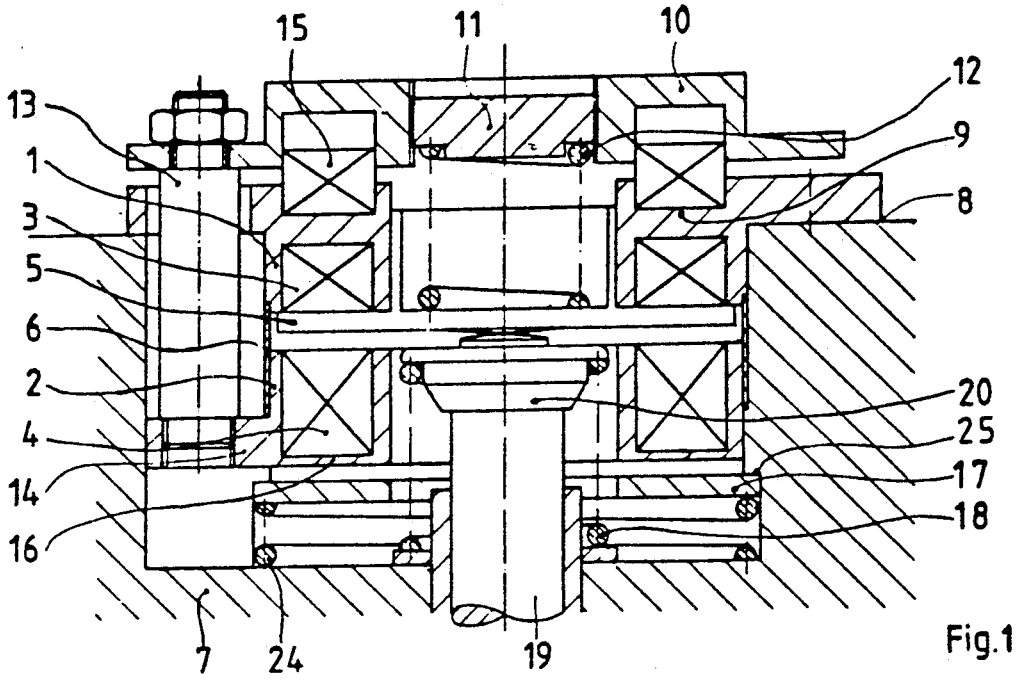
FIG. 1 is a longitudinal section view of an embodiment of the device of the invention with an electromagnetic switching system to change the working stroke, in the switched off state and in the position of the small working stroke, and the control valve of a displacement engine is closed.

Referring to FIG. 1, an electromagnetically operating setting device is shown with working magnets 1 and 2, windings 3 and 4 and armature 5. Working magnet 1 is braced in housing 7 by means of a sleeve 6 and screwed to housing 7 by means of a shoulder 8.

Working magnet 1 and a stationary yoke 9 of the switching system form one unit. A moveable armature 10 of the electromagnetic switching system acts via an adjustable set screw 11 on a spring 12, which is braced on the plate of the armature 5. Furthermore, armature 10 is connected by means of a connecting bolt 13 to working magnet 2, which can be axially displaced in the sleeve 6. A fastening lug 14, which is forced against the bottom edge of sleeve 6 by the force of the prestressed spring 12, forms the stop by means of which in the system shown the position of the working magnet 2 and thus the working stroke is adjusted. Working magnet 2 is dimensioned in such a manner on its bottom side that the cross-sectional area 16 available to the magnetic circuit between the winding 4 and the bottom side is clearly smaller than the other cross-sectional areas of the magnetic circuit and thus the magnetic reluctance is already increased with a mean magnetization of the magnetic circuit. In housing 7 a soft iron disk 17 is forced against a stop 25 by means of the prestress force of a spring 24.

Figure 2:
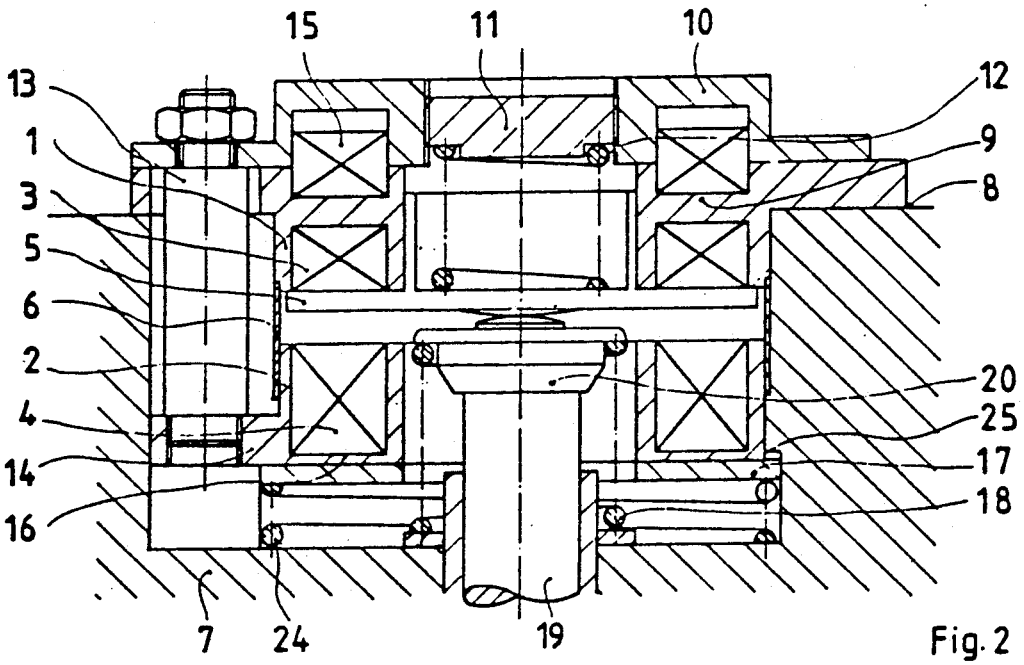
FIG. 2 shows an embodiment of FIG. 1 in the switched-on state of the switching system and thus in the position of the large working stroke, with the control valve of the displacement engine closed.

The pulled-in position of armature 10 against yoke 9 represents the stop for the position of the switching system shown in FIG. 2. Disk 17 in this position simultaneously expands the cross-sectional area of the magnetic circuit and thus reduces the magnetic reluctance in the working magnet 2. In this position disk 17 is moved away from stop 25 by a short distance by the working magnet 2 against the force of the prestressed spring 24, and thus it is ensured that working magnet 2 will rest reliably on disk 17.

The position of equilibrium of the oscillatory system comprising springs 12 and 18 and armature 5, shaft 19 of the control element to be actuated and spring washer 20 is adjusted in such a manner by means of the set screw 11 that armature 5 rests in the de-energized state at approximately the center between working magnets 1 and 2 at a position of equilibrium.

In this position the control element that is connected to shaft 19, for example a control valve of an internal combustion engine, is opened by its half stroke. If armature 5 is brought to rest on magnet 1, it is held there by exciting winding 3. In this position the control element is in the closed position. To operate the setting device, the current in winding 3 is then switched off, where-upon after a period of time which is called the decay time in the following, armature 5 detaches itself from magnet 1 and moves toward magnet 2 beyond the position of equilibrium. Winding 4 of magnet 2 is excited in due time so that armature 5 is attracted to magnet 2 due to the acting magnetic force and is held there to thereby open the control element. The return takes place analogously. This sequence of events applies to both possible working strokes.

When winding 15 of the switching system is in the de-energized state, the system is in the position of the small or minimum working stroke. If winding 15 of the switching system is excited, armature 10 is drawn against yoke 9 against the force of the prestressed spring 12. To prevent any uncontrolled states, armature 5 remains at working magnet 1, where it is held by exciting winding 3. The movement of armature 10 is transferred via connecting bolt 13 to working magnet 2 and moves this working magnet against disk 17. In this manner working magnet 2 acts through an enlarged cross-sectional area 16, which makes it possible to compensate for an increased level of force by means of a larger or maximum working stroke and thus to hold constant the current level to hold armature 5 at working magnet 2 and the decay time after winding 4 has been switched off upon the start of the movement of the armature. Due to the displacement of the base of spring 12, the position of equilibrium of the oscillating system 5, 12, 18, 19, 20 lies again in the center between working magnets 1 and 2. When the remaining air gap between armature 10 and yoke 9 is small, the switching system maintains its position with a small quantity of current.

Figure 3:
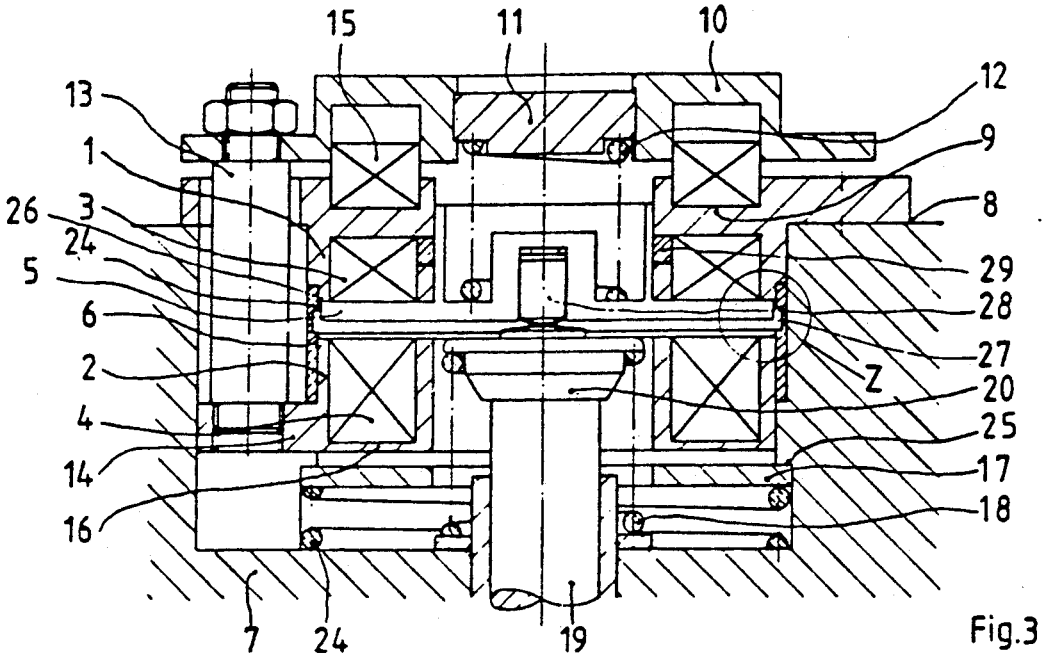
FIG. 3 shows an embodiment of a device of the invention with the movement of the armature attenuated, the length compensated hydraulically and with a permanent magnet in the working magnet assigned to the closing position, wherein the component setting the magnetic reluctance can be displaced.
Figure 4:
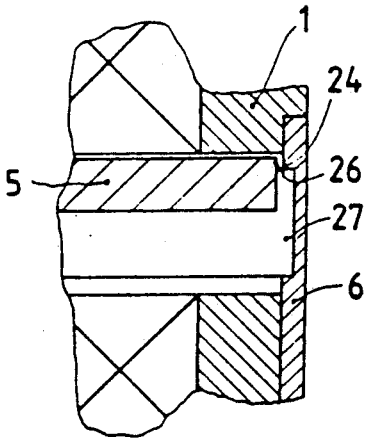
FIG. 4 shows a detail of the embodiment of FIG. 3 and corresponds to the encircled part with the reference symbol Z.

FIG. 3 shows a setting device, which, in addition to the features described above, attenuates or brakes the movement of armature 5. As apparent from FIG. 4, armature 5 forms with its top edge 26 a sealing gap relative to sleeve 6. Sleeve 6 is provided with a tapping 27 by means of which the air or other gaseous medium can flow from the volume above the armature into the volume below the armature. In the vicinity of the pole surface of the upper magnet 1, the top edge 26 leaves the upper edge 24 of tapping 27; and the thus generated force attenuates an acceleration of armature 5 which would otherwise occur owing to the tractive force which increases progressively in the vicinity of magnet 1. This braking is such that the movement of the armature is not decelerated in the center region between the switching magnets. In addition, this braking can occur in the other direction or in both directions by suitable arrangements of tappings and associated air gaps.

As shown in FIG. 3, the setting device can also contain a hydraulic length compensating element 28, which is braced in armature 5 and acts on shaft 19 of the control element. Length compensating element 28 can be supplied with pressure oil via armature 5.

A permanent magnet 29 can be arranged in working magnet 1. This permanent magnet makes it possible to hold armature 5 without a flow of current in winding 3 and it facilitates the attraction of armature 5. Therefore, winding 3 can be operated at a low current level with respect to the energy to be raised during attraction as compared to a design without permanent magnets. To detach armature 5 from the pole surface of magnet 1, winding 3 is operated with reversed polarity of the direct current as compared to the attraction process. The excited field acts against the field of permanent magnet 29, and the force acting on armature 5 decreases until the force of the stressed spring 12 overcomes the permanent magnet field and accordingly initiates the movement.

Figure 5:
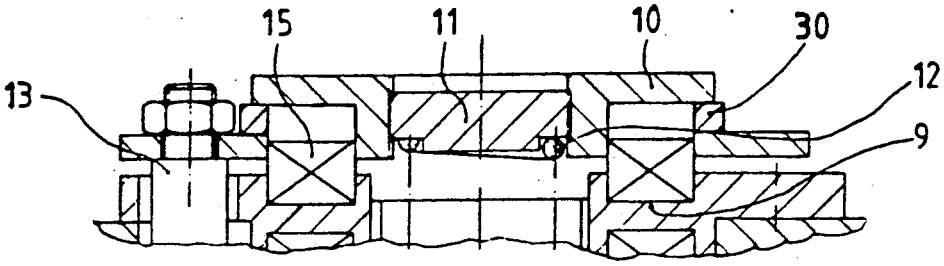
FIG. 5 shows an embodiment with a permanent magnet arranged in the switching system.

FIG. 5 shows an embodiment for an electromagnetic switching system comprising yoke 9 and armature 10 with a permanent magnet 30. To attract armature 10 to yoke 9, winding 15 is excited. When armature 10 abuts against yoke 9, winding 15 can be switched off. To detach armature 10, winding 15 is excited with reverse polarity of the direct current.

Figure 6:
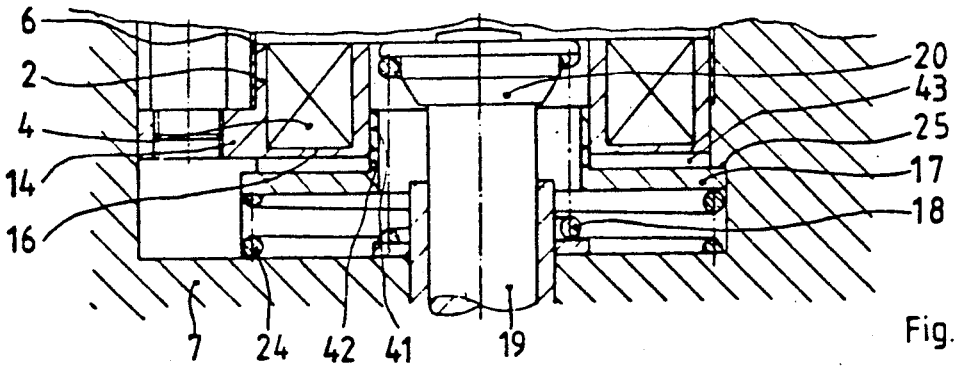
FIG. 6 shows an embodiment of a device to attenuate the movement of the switching system through the compression of air.

FIG. 6 shows a configuration to attenuate the switching movement of the switching system in the direction of movement from the small working stroke to the large working stroke. The soft magnetic disk 17 is provided on the inner edge with a sleeve 41, which forms a sealing gap relative to the working magnet 2. Sleeve 41 contains openings 42 which permit the air to escape when working magnet 2 moves and thus when chamber 43 becomes smaller until working magnet 2 closes the opening in the vicinity of disk 17 and the remaining air is compressed. A damping force is generated by this increase in pressure in chamber 43 from the compression.

Figure 7:
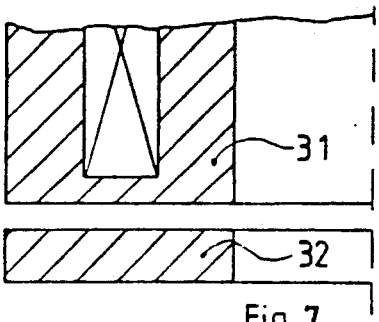
FIGS. 7–13 show various embodiments to adjust the magnetic reluctance of a working magnet.
Figure 8:
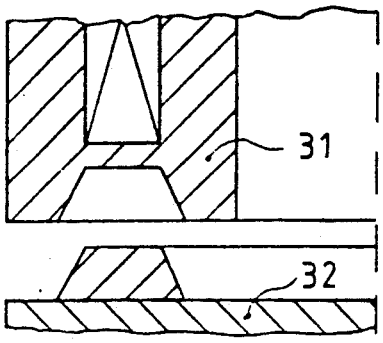
Figure 9:
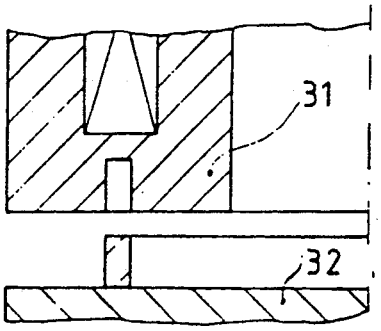
Figure 10:
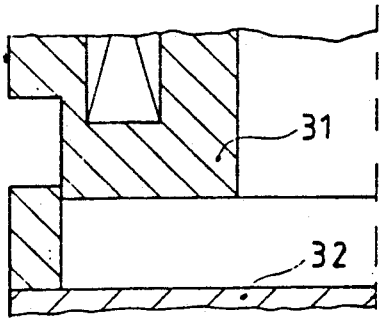
Figure 11:
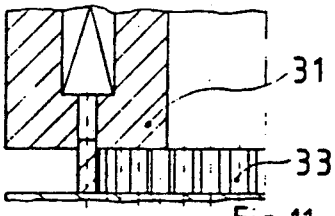
Figure 12:
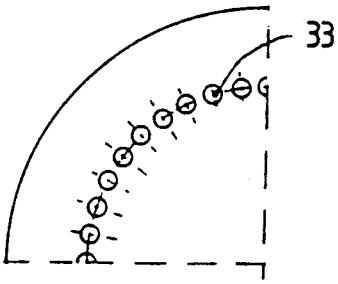
Figure 13:
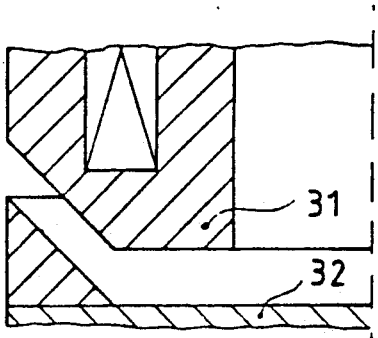

FIGS. 7 to 13 show other embodiments to change the magnetic reluctance of the working magnet. Important for the faultless function of the setting device is the accurate repeatability of the contact between the affected working magnet and the soft iron disk, which are denoted with the reference numerals 31 and 32 in the respective drawings cited. Merely small differences in the air gap between these components can change the decay times. Conical designs according to FIGS. 8 and 13 permit an automatic centering; flat horizontal designs according to FIG. 7 are simple to fabricate; vertical designs according to FIGS. 9 and 10 yield a constant radial gap; whereas a design with pins 33 of FIGS. 11 and 12 is insensitive to inaccuracies in the fabrication of individuals fits due to the plurality of elements.

FIGS. 14 to 17 show alternatives to the design of the setting device shown in FIGS. 1 and 2. The setting device is shown in a simplified drawing and it contains essentially one upper spring 50, working magnets 51 and 52 having an armature therebetween, a bottom spring 53 and an electromagnetic switching system 55.

Figure 14:
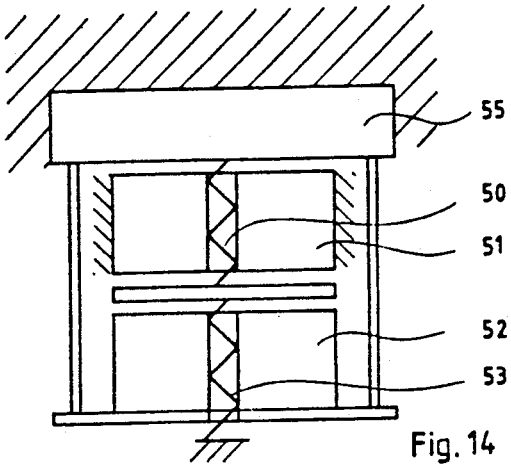
FIGS. 14–17 show various embodiments of the configuration of the switching system to adjust the opening-working magnet.
Figure 15:
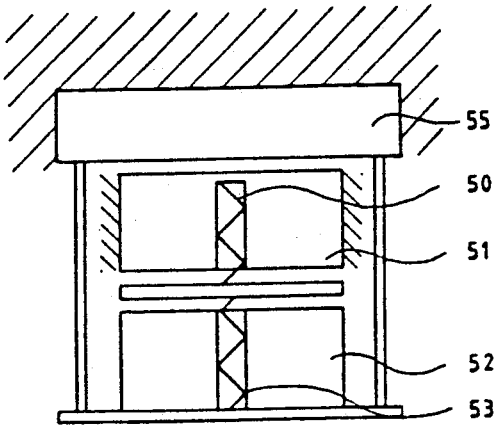
Figure 16:
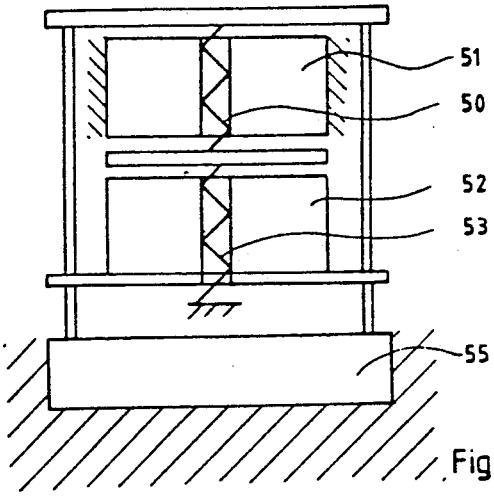
Figure 17:
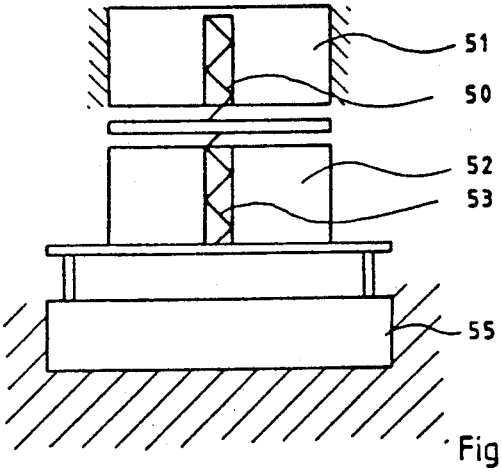

When the base of the upper spring 50 is adjusted in accordance with FIGS. 14 and 16, it is logical to correct the magnetic reluctance at both working magnets 51 and 52; above all, however, it is expedient to correct the reluctance at magnet 52 due to the required short opening times. If the base of the bottom spring 53 is adjusted, the force level at magnet 51 is constant and independent of the stroke when the valve is closed. A correction is expedient only at magnet 52. The design of the electromagnetic switching system 55 in accordance with the presentation in FIGS. 16 and 17 below the setting device enables a compact connection with magnet 52, in particular in combination with the adjustment of the spring base of the bottom spring 53 of FIG. 17.

Figure 18:
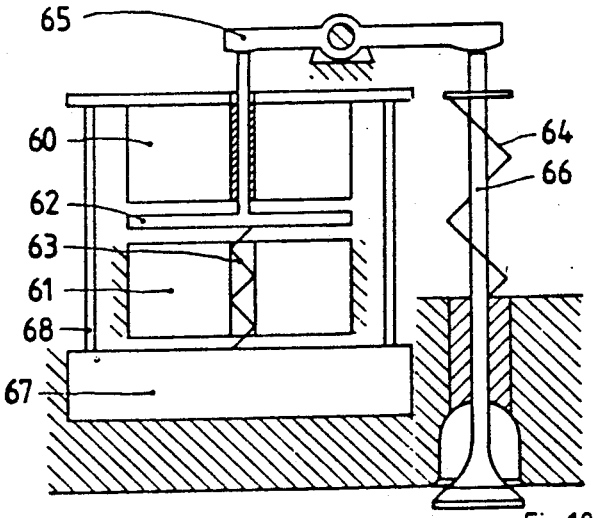
FIG. 18 shows an embodiment of the device with a control element actuated by means of a rocker arm.

FIG. 18 shows in a less complicated representation an embodiment of the setting device with working magnets 60 and 61, armature 62, springs 63 and 64, rocker arm 65 and control valve 66. An electromagnetic switching system 67 moves magnet 60 and spring 63 by means of rod 68. In consideration of the transformation ratio, springs 63 and 64 have one-half the entire spring rigidity of the oscillating system.

Though the present invention is described with reference to particular preferred embodiments, many modifications and improvements will become apparent to one skilled in the art without departing from the spirit and scope of the present invention as defined in the following claims.

We claim:

1. An electromagnetically operable setting device for at least one oscillatingly movable control element of displacement engines, comprising:

two switching electromagnets respectively defining two switching positions corresponding to opened and closed positions of the control element;

an armature located between said two electromagnets and in communication with at least one control element;

a spring system for moving said armature between the two switching positions to actuate the control element between opened and closed positions defining a working stroke therebetween, said spring system comprising at least one spring having an initial equilibrium position located approximately at the center of the two switching positions; and a magnetic switching system for moving the position of a pole surface of one of said electromagnets and simultaneously changing a base position of at least one spring of said spring system to adapt the oscillation mid-point of the spring system to result in another spring system equilibrium position located approximately at the center of said moved and unmoved electromagnets, whereby the working stroke of the control element is varied.

2. The setting device according to claim 1, further comprising means for varying the magnetic reluctance of at least one of said two electromagnets, whereby the decay time of the spring moved armature is varied.

3. The setting device according to claim 2, wherein the reluctance varying and said magnetic switching system means comprise a common electromagnetic switching system.

4. The setting device according to claim 1, further comprising means for adjusting the position of said working magnet defining the switching position corresponding to the opened position of the control element to increase the working stroke of the control element when said magnetic switching system is in a de-energized state.

5. The setting device according to claim 1, further comprising means for adjusting the position of said working magnet defining the switching position corresponding to the opened positions of the control element to decrease the working stroke of the control element when said magnetic switching system is de-energized.

6. The setting device according to claim 1, further comprising a mechanical force transfer element communicating with said armature and the control element, whereby the control element is actuated.

7. The setting device according to claim 6, wherein the mechanical transfer element comprises a rocker arm or finger follower connected between said armature and the control element.

8. The setting device according to claim 1, further comprising a brake to brake the movement of said armature in the vicinity of at least one of the switching positions defined by said electromagnets.

9. The setting device according to claim 1, further comprising a brake to brake the movement of said armature between said two electromagnets in the vicinity of at least one switching positions by compressing a gaseous medium.

10. The setting device according to claim 8, wherein the brake attenuates the movement of said armature only in the vicinity of at least one switching positions, whereby the armature movement is not decelerated in a center region between the two switching positions.

11. The setting device according to claim 1, further comprising at least one hydraulic length compensating element to compensate for lash between said movable elements.

12. The setting device according to claim 11, wherein at least one hydraulic valve element is located between said armature and the control element.

13. The setting device according to claim 11, further comprising a housing and wherein at least one hydraulic length compensating element is located between the housing and said electromagnet defining the switching position corresponding to the closed position of the control element.

14. The setting device according to claim 1, further comprising a permanent magnet arranged in the electromagnet defining the switching position corresponding to the closed position of the control element.

15. The setting device according to claim 1, further comprising a permanent magnet arranged in the electromagnet defining the switching position corresponding to the opened position of the control element.

16. The setting device according to claim 1, further comprising a permanent magnet in the magnetic circuit of the switching system which holds said armature of the switching system in the switching position corresponding to the pulled-in position.

17. The setting device according to claim 2, wherein the means for varying the magnetic reluctance comprises means for increasing and decreasing the cross-sectional area of the electromagnet whose magnetic reluctance is varied, the increasing and decreasing means comprising a metallic disk and a flexible element which biases the metallic disk towards this electromagnet.

* * * * *